US008641033B2

(12) United States Patent
Wada et al.

(10) Patent No.: US 8,641,033 B2
(45) Date of Patent: Feb. 4, 2014

(54) SHEET FEEDING UNIT AND PRINTER

(75) Inventors: Toshihide Wada, Yokohama (JP); Toshiaki Tokisawa, Yokohama (JP); Kanto Kurasawa, Kawasaki (JP); Yoshiaki Suzuki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 12/965,096

(22) Filed: Dec. 10, 2010

(65) Prior Publication Data

US 2011/0267411 A1 Nov. 3, 2011

(30) Foreign Application Priority Data

Apr. 28, 2010 (JP) ..... 2010-103797

(51) Int. Cl.
*B65H 5/26* (2006.01)
*B65H 83/00* (2006.01)
*B65H 85/00* (2006.01)

(52) U.S. Cl.
USPC ..... 271/9.12; 271/3.14; 271/3.18; 271/3.24

(58) Field of Classification Search
USPC ..... 271/3.14, 3.18, 3.24, 264, 272, 9.12; 347/104
See application file for complete search history.

(56) References Cited

U.S. PATENT DOCUMENTS

| | | | | |
|---|---|---|---|---|
| 4,885,613 | A * | 12/1989 | Kudoh | 399/23 |
| 5,963,755 | A * | 10/1999 | Ueda et al. | 399/23 |
| 7,421,241 | B2 * | 9/2008 | deJong et al. | 399/381 |
| 2005/0017427 | A1 * | 1/2005 | Andersen et al. | 271/3.14 |
| 2006/0214364 | A1 * | 9/2006 | Clark et al. | 271/228 |
| 2010/0264574 | A1 * | 10/2010 | Tyson et al. | 271/3.14 |

FOREIGN PATENT DOCUMENTS

| | | | |
|---|---|---|---|
| JP | 5-4773 | A | 1/1993 |
| JP | 9-301623 | A | 11/1997 |

* cited by examiner

*Primary Examiner* — Patrick Cicchino
(74) *Attorney, Agent, or Firm* — Canon USA Inc. IP Division

(57) ABSTRACT

A sheet feeding unit to be inserted between a printer main unit and a sorting unit having a plurality of discharge trays. The sheet feeding unit includes a casing in which a sheet is housed and through which a feed path and a discharge conveyance path extend horizontally. The casing has on a face thereof adjacent to the printer main unit an exit of the feed path and an entrance of the discharge conveyance path, and on a face thereof adjacent to the sorting unit an entrance of the feed path and an exit of the discharge conveyance path. The positions of the exit and entrance of the feed path coincide with each other when seen in a conveyance direction, and the positions of the entrance and exit of the discharge conveyance path coincide with each other when seen in the conveyance direction.

20 Claims, 11 Drawing Sheets

SHEET FEEDING UNIT AND PRINTER

BACKGROUND OF THE INVENTION

1. Field of the Invention

The present invention relates to a sheet feeding unit and a printer.

2. Description of the Related Art

In general, to perform printing on sheets of different sizes, sheet feeders provided for feeding the sheets of respective sizes are necessary. In addition, since such sheets that have undergone printing are usually sorted by size or intended use and are output to different discharge trays, a sorter having a number of discharge trays is used.

In Japanese Patent Laid-Open No. 5-4773, although a sheet feeder is not shown in drawings provided therein, a printer main body (an image forming apparatus) that performs printing and the like and a sorter that sorts printed sheets and discharges the sheets to discharge trays are provided as units that are connectable to each other.

In Japanese Patent Laid-Open No. 9-301623, two sorters provided as units are connected to a printer main body (an image forming apparatus) that performs printing and the like.

Although Japanese Patents Laid-Open No. 5-4773 and No. 9-301623 each disclose a sorter that sorts printed sheets into a plurality of groups and discharges the sorted sheets, the disclosures each do not include a configuration for feeding sheets of a plurality of kinds. Actually, even if it is desired to handle sheets of more kinds in one printer, there have been no proposals concerning a feeder that meets such a desire.

SUMMARY OF THE INVENTION

The present invention provides a sheet feeding unit used when sheets of more kinds are to be handled and a printer including the sheet feeding unit.

According to a first aspect of the present invention, a sheet feeding unit is to be inserted between a printer main unit configured to perform printing on a sheet and a sorting unit having a plurality of discharge trays to which the sheet that has undergone printing is to be discharged. The sheet feeding unit is connectable to the printer main unit, the sorting unit, and another sheet feeding unit. The sheet feeding unit includes a casing in which the sheet, as a recording medium, is housed and through which a feed path and a discharge conveyance path extend horizontally, the feed path being configured to feed the sheet to the printer main unit, the discharge conveyance path being configured to convey the sheet that has undergone printing performed by the printer main unit to the sorting unit. The casing has on a face thereof adjacent to the printer main unit an exit of the feed path and an entrance of the discharge conveyance path, and on a face thereof adjacent to the sorting unit an entrance of the feed path and an exit of the discharge conveyance path. The positions of the exit and entrance of the feed path coincide with each other when seen in a conveyance direction in which the sheet is conveyed, and the positions of the entrance and exit of the discharge conveyance path coincide with each other when seen in the conveyance direction.

According to a second aspect of the present invention, a printer includes a printer main unit, a sorting unit, and at least one sheet feeding unit according to the first aspect of the present invention provided between the printer main unit and the sorting unit. The positions of the entrance and exit of the feed path of the sheet feeding unit and an entrance of the printer main unit from which the sheet enters coincide with one another when seen in the conveyance direction. The positions of the entrance and exit of the discharge conveyance path of the sheet feeding unit, an exit of the printer main unit from which the sheet exits, and an entrance of the sorting unit from which the sheet enters coincide with one another when seen in the conveyance direction.

According to the above aspects of the present invention, the number of kinds of sheets, as recording media, to be handled can be easily increased arbitrarily, and good operability in feeding and discharging such sheets is realized.

Further features of the present invention will become apparent from the following description of exemplary embodiments with reference to the attached drawings.

DESCRIPTION OF THE EMBODIMENTS

An embodiment of the present invention will now be described with reference to the attached drawings. The following embodiment concerns an inkjet printer. The printer is a high-speed line printer capable of performing both simplex printing and duplex printing on a continuous form of paper, synthetic resin, or the like that is wound in a roll. The printer cuts the continuous form that has undergone printing into sheets of specific sizes and discharges the sheets. The printer is particularly suitable for bulk printing performed in printing laboratories and the like.

Figure 1:
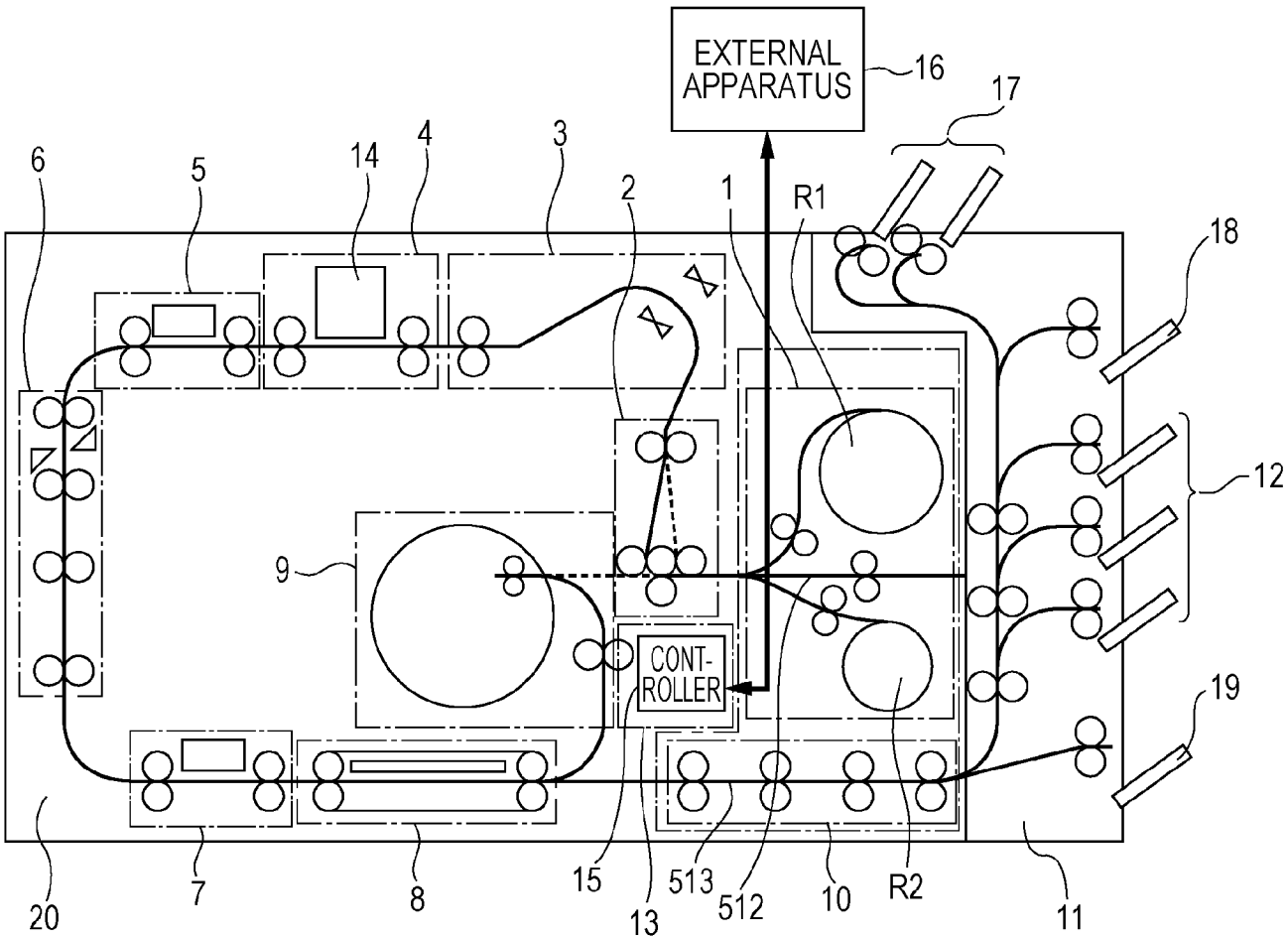
FIG. 1 is a schematic diagram showing the internal configuration of a printer according to an embodiment of the present invention.

FIG. 1 is a schematic diagram showing the internal configuration of the printer. The basic configuration of the printer will first be described.

The printer basically includes the following devices provided along a conveyance path shown by the solid lines. Devices responsible for feeding of a continuous form, performance of printing on the continuous form, and cutting of the continuous form into sheets include a form feeding section 1, a decurling section (curl reducing section) 2, a skew correcting section 3, a printing section 4, an inspecting section 5, and a cutting section 6. Devices responsible for conveyance, sorting, and discharging of the cut sheets include an information recording section 7, a drying section 8, a form winding section 9, a discharge-conveyance section 10, and a sorting section (sorting unit) 11. The printer further includes a control section 13 that controls the operations of the foregoing devices included in the printer. The printer has a printer main unit 20 including the form feeding section 1, the decurling section 2, the skew correcting section 3, the printing section 4, the inspecting section 5, the cutting section 6, the information recording section 7, the drying section 8, the form winding section 9, the discharge-conveyance section 10, and the control section 13. The sorting section 11, i.e., the sorting unit, is connected to the printer main unit 20. The term "unit" used herein denotes an apparatus whose mechanisms performing specific processing operations are housed in a casing and is operable as a stand-alone apparatus. Such units are connectable to each other.

The sorting unit 11 has a group of trays. In the embodiment, the group of trays includes, for example, large-sized-sheet discharge trays 12 and 18, small-sized-sheet discharge trays 17, and an unnecessary-sheet discharge tray 19, the trays being used selectively. One of the large-sized-sheet discharge trays 12 and 18 that has the largest capacity is referred to as a large-sized-sheet bulk discharge tray 18.

Most of the devices of the printer include conveying mechanisms including pairs of rollers and belts. The continuous form (or the sheet) is conveyed along the conveyance path by the conveying mechanisms and undergoes processing operations performed by the devices.

The form feeding section 1 houses a continuous form that is wound in a roll and feeds the continuous form. In the embodiment, the form feeding section 1 can house two continuous-form rolls R1 and R2. The form feeding section 1 unwinds a continuous form from either of the rolls R1 and R2 and feeds the continuous form to the device provided on the downstream side. The number of continuous-form rolls that can be housed in the form feeding section 1 is not limited to two. The form feeding section 1 may house only a single roll, or three or more rolls.

The decurling section 2 reduces a curl of the continuous form fed from the form feeding section 1. The decurling section 2 includes one driving roller and two pinch rollers provided on both sides of and in contact with the driving roller. The continuous form fed to the decurling section 2 passes through the nip between the driving roller and either of the pinch rollers and is squeezed such that the form is bent in the direction opposite to the direction of the curl thereof produced by having been wound in a roll, whereby the curl is reduced. Which of the two pinch rollers is to be used depends on the direction of the curl.

The skew correcting section 3 corrects any skew of the continuous form (a phenomenon that the continuous form advances while deviating from the initial position) that has passed through the decurling section 2. One of the sides of the continuous form that is defined as the reference side is pressed against a guide member (not shown), whereby the skew of the sheet is corrected.

The printing section 4 performs printing (forms an image) on the continuous form that is being conveyed. The printing section 4 includes a plurality of print heads 14 arranged parallel to each other and side by side in a conveyance direction, and a plurality of conveying rollers that convey the continuous form. The print heads 14, with which printing is performed, are line print heads each having rows of inkjet nozzles provided in such a manner as to cover the width of the largest continuous form among various kinds of continuous forms to be used. In the embodiment, seven print heads 14 for seven colors of cyan (C), magenta (M), yellow (Y), light cyan (LC), light magenta (LM), gray (G), and black (K) are provided. The numbers of colors and print heads 14 are each not limited to seven. Moreover, any of various inkjet methods may be employed, such as those employing heater devices, piezo devices, electrostatic devices, microelectromechanical systems (MEMS), and the like. Inks for the foregoing colors are supplied from ink tanks (not shown) through ink tubes to the print heads 14.

The inspecting section 5 includes an optical device and inspects the condition of the nozzles of the print heads 14, the state of conveyance, the image position, and so forth by optically reading an inspection pattern and/or an image formed on the continuous form by the printing section 4.

The cutting section 6 includes a mechanical cutter and cuts the continuous form that has undergone printing into sheets of specific lengths. The cutting section 6 also includes a plurality of conveying rollers that convey the cut sheets toward the downstream side.

The information recording section 7 includes a printing mechanism and records printing information such as the serial number and the date on the back side (non-printed side) of each cut sheet. The printing mechanism of the information recording section 7 may be the same as the print head 14 of the printing section 4, or may be smaller and simpler than the print head 14. The printing mechanism is not limited to an inkjet mechanism and may be a mechanism that operates in a simpler manner. In duplex printing, the information recording section 7 does not operate, as described separately below.

The drying section 8 includes a dryer and heats the sheet (or the continuous form in duplex printing) that have undergone printing performed by the printing section 4, thereby quickly drying the ink on the sheet. The drying section 8 also includes a conveying belt and conveying rollers that convey the sheet toward the downstream side.

In duplex printing, the continuous form that has undergone front-side printing is temporarily wound up by the form winding section 9. The form winding section 9 includes a rotatable winding drum around which the continuous form is wound. In duplex printing, after front-side printing is finished, the continuous form is conveyed without being cut and is temporarily wound around the winding drum in the form winding section 9. When the entirety of the continuous form has been wound up, the winding drum rotates in the reverse direction, whereby the continuous form that has been wound is fed into the decurling section 2 and is conveyed to the printing section 4 (the conveyance path in this case is shown by the broken line). Since the front and back sides of the continuous form that has been unwound from the winding drum are reversed, the printing section 4 can perform printing on the back side of the continuous form. More specific operations performed in duplex printing will be described separately below.

The discharge-conveyance section 10 basically includes pairs of rollers. The discharge-conveyance section 10 conveys each cut sheet obtained by the cutting section 6 and dried by the drying section 8 (in duplex printing, each sheet obtained after back-side printing, cutting, and drying), and delivers the sheet to the sorting unit 11. In the embodiment of the present invention, the discharge-conveyance section 10 is provided below the form feeding section 1.

The sorting unit 11, i.e., the sorting section, sorts printed sheets according to need and discharges the sheets. In the embodiment, a group of trays including the large-sized-sheet discharge trays 12, the small-sized-sheet discharge trays 17, the large-sized-sheet bulk discharge tray 18, and the unnecessary-sheet discharge tray 19 are selectively used. The sheets are sorted by the sorting unit 11 and are discharged to corresponding ones of the discharge trays. The large-sized-sheet discharge trays 12 and 18 are provided on the upstream side in the conveyance direction in the sorting unit 11, i.e., on a side face of the printer. Among the large-sized-sheet discharge trays 12 and 18, the large-sized-sheet bulk discharge tray 18 has the largest capacity and is distinguished from the other large-sized-sheet discharge trays 12 in the drawings. The small-sized-sheet discharge trays 17 are provided on the downstream side, i.e., on the top face of the printer. The unnecessary-sheet discharge tray 19 is provided on the upstream side in the conveyance direction in the sorting unit 11 with respect to the large-sized-sheet discharge trays 12 and the large-sized-sheet bulk discharge tray 18, i.e., at the lowermost position on the side face of the printer. The technical significance of such an arrangement of the discharge trays 12, 17, 18, and 19 will be described separately below.

The control section 13 controls the devices included in the printer. The control section 13 includes a controller 15 and a power supply (not shown). The controller 15 includes a central processing unit (CPU), a memory, and input/output (I/O) interfaces. An external apparatus 16 such as a host computer or the like is connected to the controller 15 via an I/O interface. The operation of the printer is controlled on the basis of instructions from the controller 15 or the external apparatus 16.

A basic printing operation performed by the printer will now be described. Simplex printing and duplex printing that are performed in different manners will be described individually.

Figure 2:
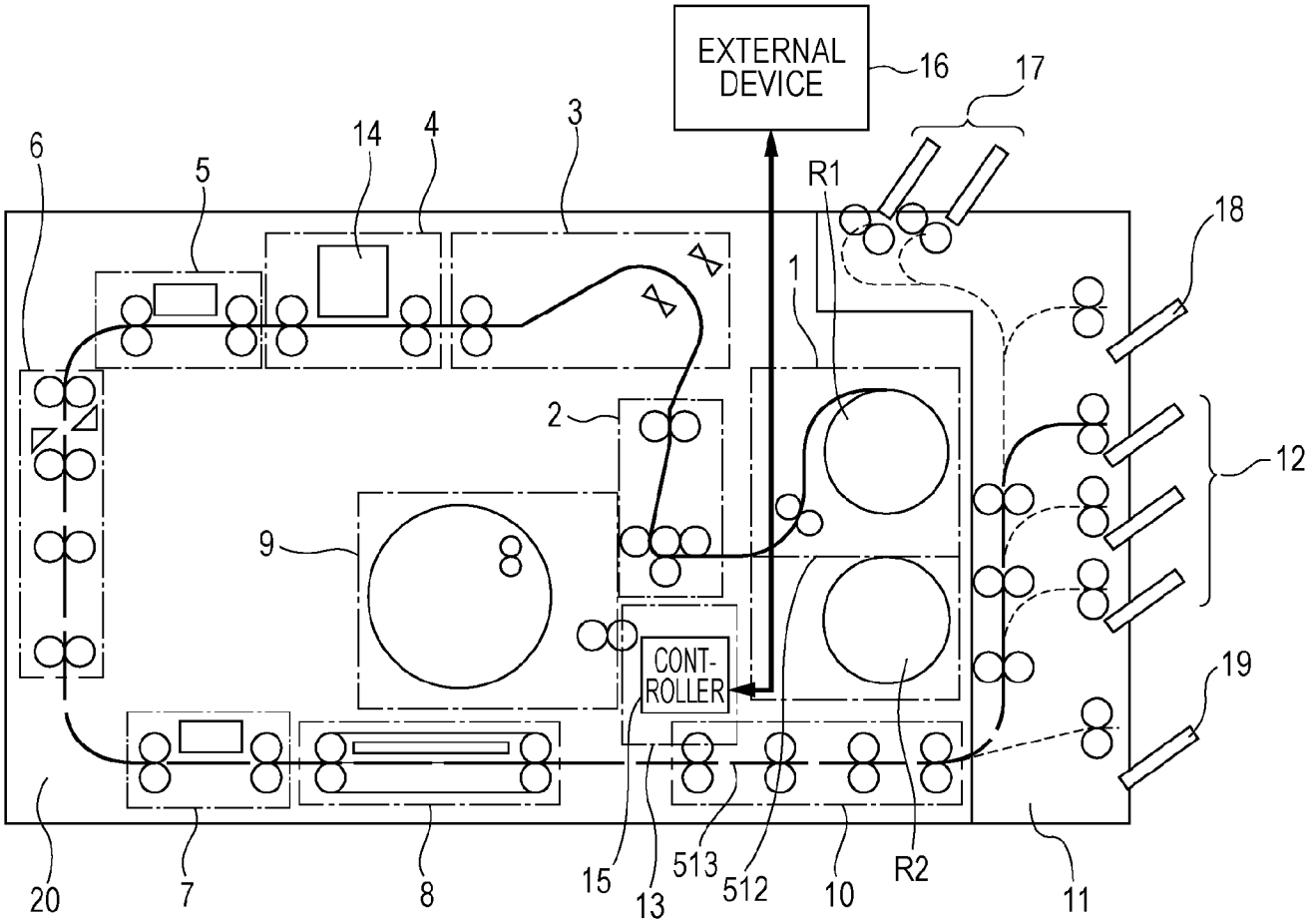
FIG. 2 is a schematic diagram for describing simplex printing performed by the printer shown in FIG. 1.

FIG. 2 is a diagram for describing the operation performed in simplex printing. A continuous form is fed from the form feeding section 1, the curl of the continuous form is reduced by the decurling section 2, any skew of the continuous form is corrected by the skew correcting section 3, and printing is performed on the front side of the continuous form by the printing section 4. The continuous form that has undergone printing is inspected by the inspecting section 5, and is cut into sheets of preset lengths by the cutting section 6. The control section 13 controls the printing section 4 and the cutting section 6 such that portions of the continuous form that are to be cut out by the cutting section 6 substantially correspond to printing areas, respectively, of the continuous form in which individual images are printed by the printing section 4. According to need, the information recording section 7 records printing information on the back side of each of the cut sheets obtained in such a manner, and the cut sheet is conveyed to the drying section 8 so as to be dried. Subsequently, the cut sheet is conveyed through the discharge-conveyance section 10 provided below the form feeding section 1 to the sorting unit 11. The sorting unit 11 performs sorting under the control of the control section 13. Specifically, cut sheets are sorted in accordance with the sizes thereof, and sheets of large sizes are discharged to the large-sized-sheet discharge trays 12, and sheets of small sizes are discharged to the small-sized-sheet discharge trays 17. When it is known that a large number of large-sized sheets are to be produced, the sheets are discharged to the large-sized-sheet bulk discharge tray 18 having the largest capacity among the large-sized-sheet discharge trays. Unnecessary sheets, such as those for test print, those having print failure, and portions corresponding to margins provided between necessary portions, are discharged to the unnecessary-sheet discharge tray 19. The method of sorting performed by the sorting unit 11 and the method of selectively discharging sorted sheets to the discharge trays may be any of known methods, and the description thereof is omitted. What kind of sorting is to be performed by the sorting unit 11 is to be determined appropriately. The embodiment of the present invention is also applicable to a case where trays to which sheets are to be discharged are sequentially changed simply in accordance with the number of sheets discharged.

Figure 3:
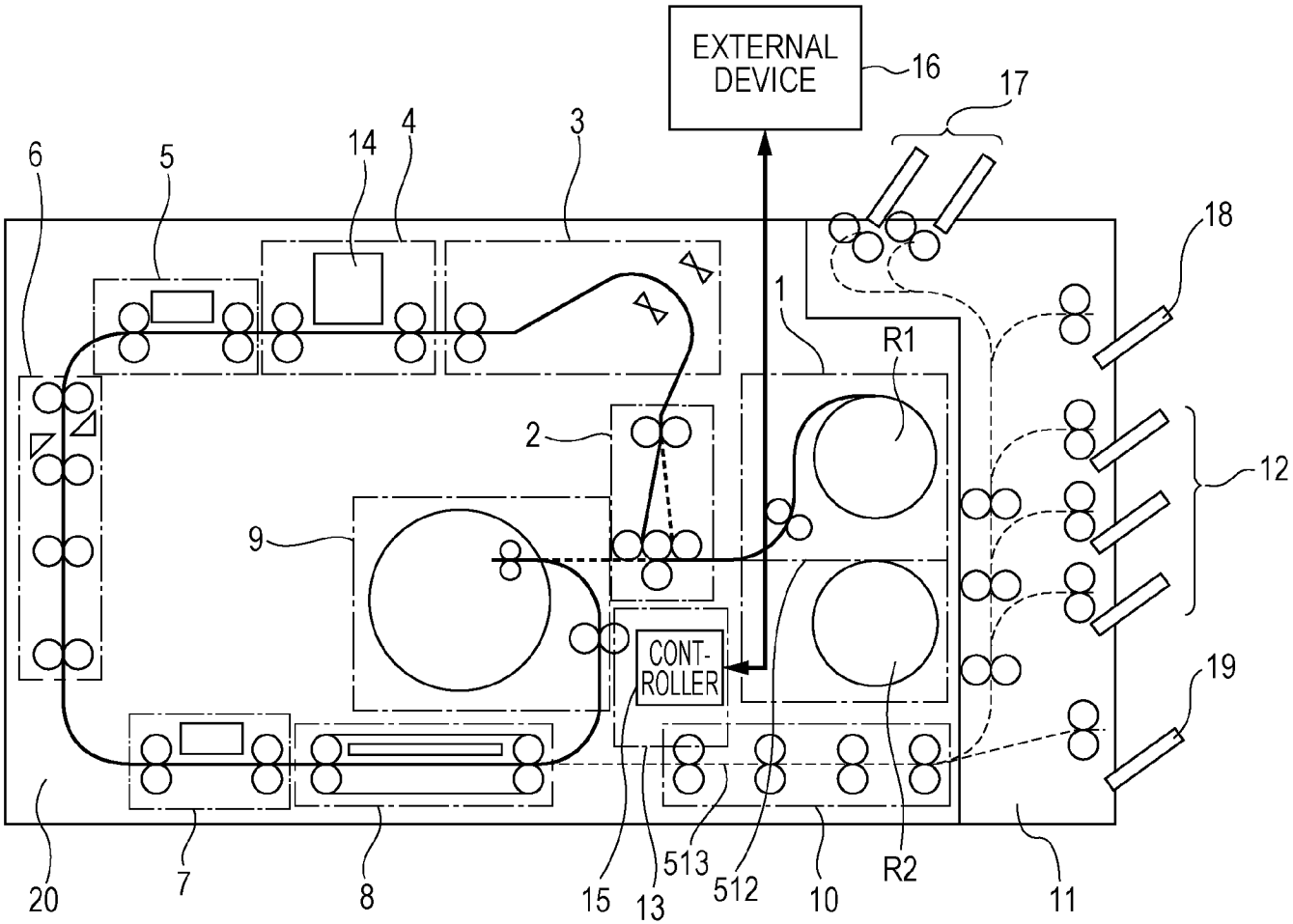
FIG. 3 is a schematic diagram for describing duplex printing performed by the printer shown in FIG. 1.

FIG. 3 is a diagram for describing the operation performed in duplex printing. In duplex printing, a front-side printing sequence is performed first, and a back-side printing sequence is subsequently performed. In the front-side printing sequence, individual operations performed by the form feeding section 1, the decurling section 2, the skew correcting section 3, the printing section 4, and the inspecting section 5 are the same as those in simplex printing. At this point, cutting of the continuous form by the cutting section 6 and recording by the information recording section 7 are not performed, and the continuous form just passes through the cutting section 6 and the information recording section 7 and is conveyed to the drying section 8, where ink on the front side of the continuous form is dried. Subsequently, the continuous form is introduced into a path extending to the form winding section 9, not into the path extending to the discharge-conveyance section 10. The continuous form that has been introduced into the path extending to the form winding section 9 is wound around the winding drum of the form winding section 9 that rotates in the forward direction (the counterclockwise direction in FIG. 3). The conveyance paths provided after the drying section 8 are switched therebetween by a known method in which a guide member or the like (not shown) is used.

When predetermined printing on the front side of the continuous form is finished by the printing section 4, the continuous form is cut at the trailing end of the entire printed portion thereof by the cutting section 6. The portion of the continuous form that is on the downstream side in the conveyance direction with respect to the cut position (the portion of the continuous form that has undergone front-side printing) is dried by the drying section 8 and is wound up to the trailing end (the cut end) thereof by the form winding section 9. Meanwhile, the portion of the continuous form that is on the upstream side in the conveyance direction with respect to the cut position (the portion of the continuous form that has not undergone front-side printing) is rewound to the form feeding section 1 such that no portion of the continuous form is left in the decurling section 2 and other sections.

After the front-side printing sequence described above, the operation proceeds to the back-side printing sequence. Specifically, the winding drum of the form winding section 9 around which the continuous form has been wound up to the trailing end thereof is rotated in the backward direction (the clockwise direction in FIG. 3), i.e., the direction opposite to that in which the continuous form has been wound up. Thus, the end of the wound continuous form (the trailing end at the time of winding becomes the leading end at the time of refeeding) is fed into the decurling section 2. The conveyance path valid in this operation is shown by the broken line in FIG. 3. In the decurling section 2, curl correction is performed in the direction opposite to the direction of curl correction performed when the continuous form is fed from the form feeding section 1. This is because the continuous form is wound around the winding drum with the front and back sides thereof reversed from those when housed in the form feeding section 1 and is curled in the opposite direction. The continuous form (the continuous form that has undergone front-side printing) whose curl is reduced by the decurling section 2 has any skew thereof corrected by the skew correcting section 3 and is conveyed to the printing section 4 again. The print heads 14 of the printing section 4 perform printing on the back side of the continuous form. The continuous form that has undergone back-side printing is inspected by the inspecting section 5 and is cut into sheets of preset lengths by the cutting section 6. The cut sheets obtained in such a manner each have images printed on the front and back sides thereof. Therefore, recording by the information recording section 7 is not performed. The cut sheets are each conveyed to the drying section 8 so as to be dried. Subsequently, each of the sheets is conveyed through the discharge-conveyance section 10 provided below the form feeding section 1 to the sorting unit 11. The sorting unit 11 sorts the sheets under the control of the control section 13, as in the front-side printing sequence. Specifically, sheets of large sizes are discharged to the large-sized-sheet discharge trays 12 (or the large-sized-sheet bulk discharge tray 18 if a large number of sheets are to be discharged), sheets of small sizes are discharged to the small-sized-sheet discharge trays 17, and unnecessary sheets are discharged to the unnecessary-sheet discharge tray 19.

As described above, the printer shown in FIG. 1 includes the sorting unit 11 and the printer main unit 20 that are connected to each other. Hence, the exit of the discharge-conveyance section 10 and the entrance of the sorting unit 11 are configured such that the sheet is smoothly conveyed from the discharge-conveyance section 10 of the printer main unit 20 to the sorting unit 11. Specifically, the exit of the discharge-conveyance section 10 and the entrance of the sorting unit 11 are of substantially the same size and shape with a thickness, i.e., a height, and a width both larger than those of a continuous form of the largest size to be used. Furthermore, the positions of the exit of the discharge-conveyance section 10 and the entrance of the sorting unit 11 are the same both in level and in width direction orthogonal to the conveyance direction. If the exit of the discharge-conveyance section 10 and the entrance of the sorting unit 11 are not of the same size and shape, the exit of the discharge-conveyance section 10 and the entrance of the sorting unit 11 coincide with each other in terms of at least the levels of the lowermost parts thereof and the widthwise centers thereof.

Figure 4:
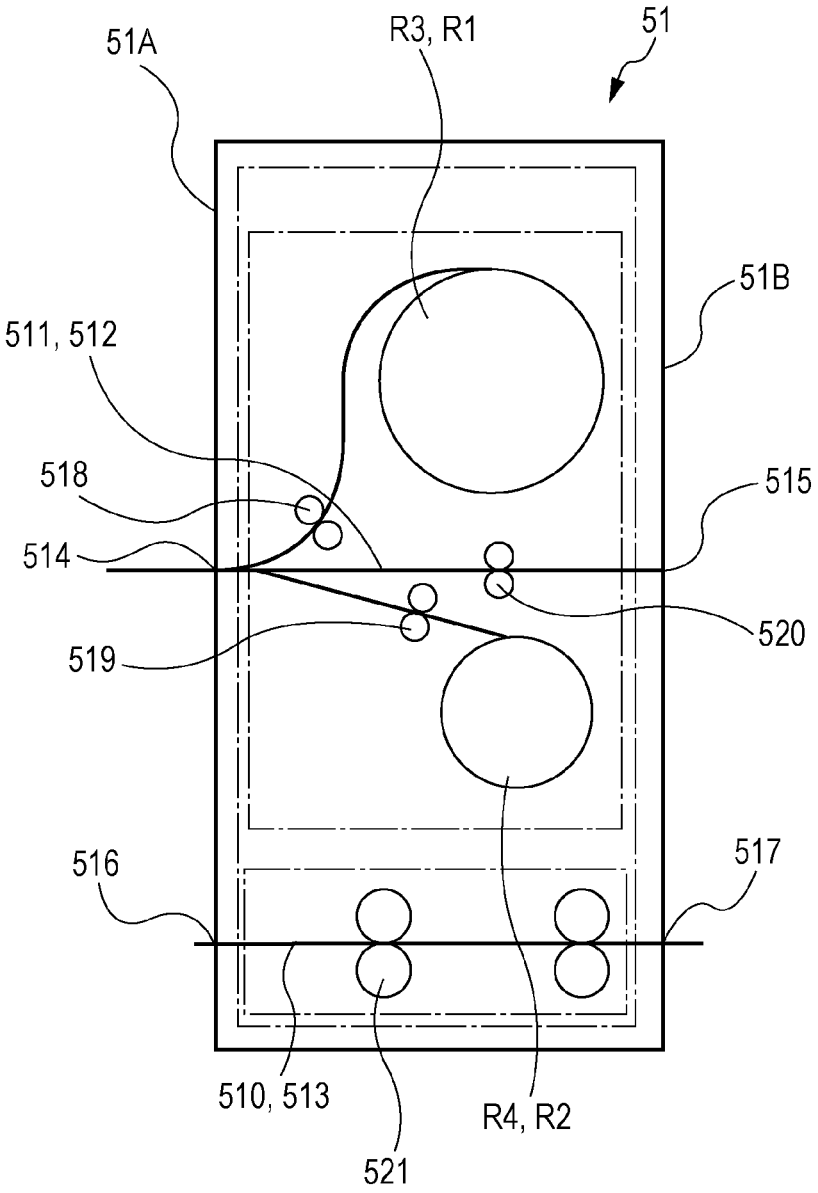
FIG. 4 is a schematic diagram of a sheet feeding unit according to the embodiment of the present invention.
Figure 5:
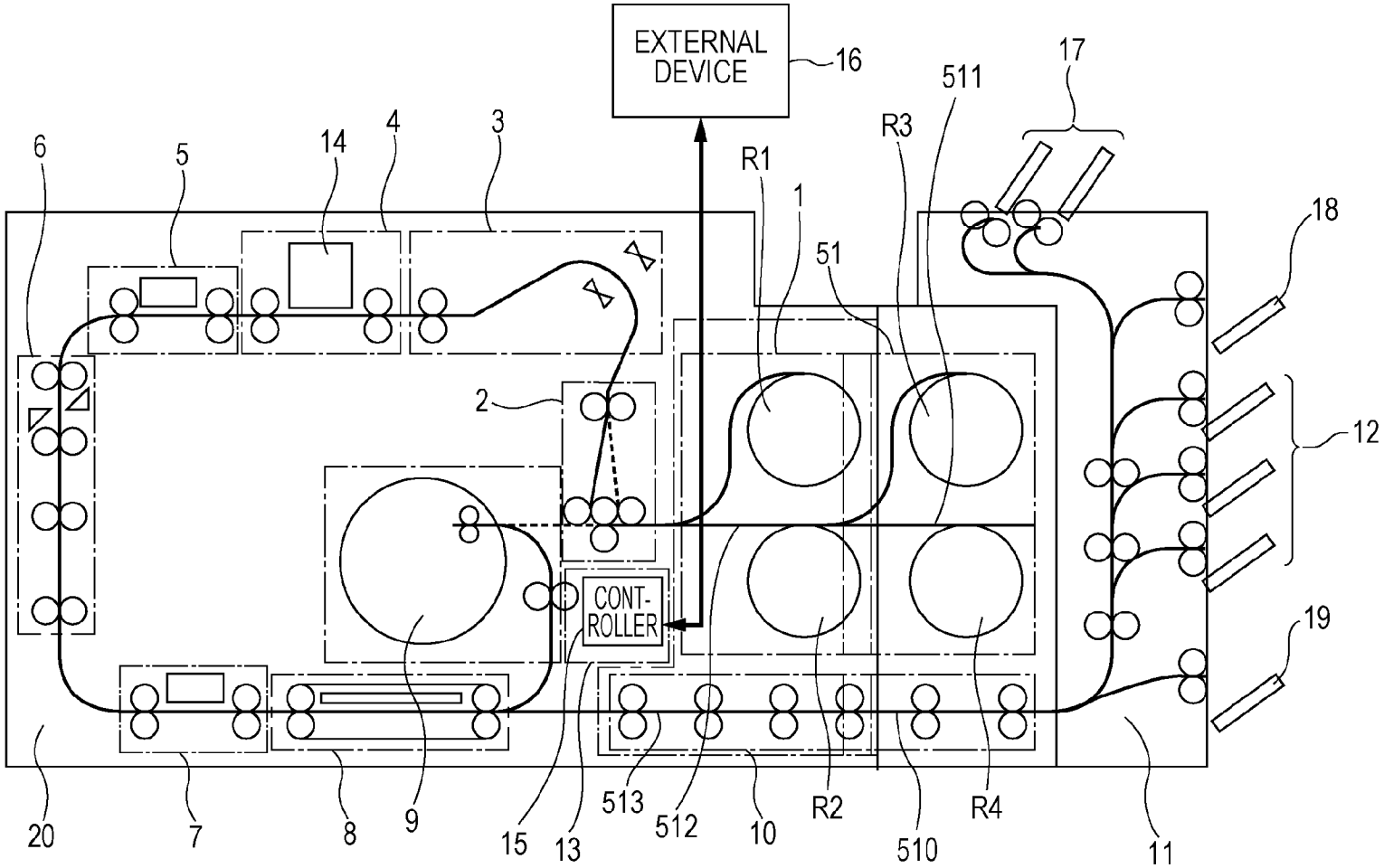
FIG. 5 is a schematic diagram showing a state where another sheet feeding unit the same as that shown in FIG. 4 is added to the printer shown in FIG. 1.

The printer according to the embodiment of the present invention allows the insertion of an additional form feeding unit 51 between the printer main unit 20 and the sorting unit 11. FIG. 4 shows the additional form feeding unit 51. FIG. 5 shows a state where one additional form feeding unit 51 is added to the configuration shown in FIG. 1.

The additional form feeding unit 51 has in a casing thereof a form housing portion in which continuous-form rolls R3 and R4 are housed. In the form feeding unit 51, a feed path 511 (a first conveyance path) and a discharge conveyance path 510 (a second conveyance path) extend in such a manner as to pass through the casing. The feed path 511 is a conveyance path extending horizontally and along which the continuous form is fed to the printer main unit 20. The discharge conveyance path 510 is a conveyance path extending horizontally from the side near the printer main unit 20 toward the sorting unit 11. The form feeding unit 51 has on one face (a feed-side face, or a second side face 51A) of the casing thereof adjacent to the printer main unit 20 an exit 514 (a first exit) of the feed path 511 and an entrance 516 (a second entrance) of the discharge conveyance path 510, and on another face (a discharge-side face, or a first side face 51B) of the casing thereof adjacent to the sorting unit 11 an entrance 515 (a first entrance) of the feed path 511 and an exit 517 (a second exit) of the discharge conveyance path 510.

A pair of rollers 520 provided on the feed path 511 functions as a first conveyor that conveys the continuous form from the entrance 515 to the exit 514. Another pair of rollers 521 provided on the discharge conveyance path 510 functions as a second conveyor that conveys each cut sheet that has undergone recording from the entrance 516 to the exit 517. A pair of feed rollers 518 functions as a sheet feeder that draws the continuous form from the roll R3 and conveys the continuous form into the feed path 511. Another pair of feed rollers 519 draws the continuous form from the roll R4 and conveys the continuous form into the feed path 511.

In addition to the pairs of rollers, shown in FIG. 4, provided on the feed path 511 and the discharge conveyance path 510, guide members (not shown) that guide the continuous form (or the sheet) are also provided, actually.

The additional form feeding unit 51 has the same configuration as the form feeding section 1. That is, units having the same configuration may be employed as the form feeding section 1 and the additional form feeding unit 51.

In the printer shown in FIGS. 1 to 3 and others, the form feeding section 1 is positioned between a set of devices that perform various processing operations on the continuous form or cut sheet and the sorting unit 11 that discharges the cut sheet that has undergone printing. In such an arrangement, attachment and removal of the continuous-form rolls R1 and R2 to and from the form feeding section 1 and removal of cut sheets from the discharge trays 12, 17, 18, and 19 of the sorting unit 11 can be performed from one specific side of the printer. That is, the user can easily perform such operations without moving from place to place. In such an arrangement, the continuous form that has been fed from the form feeding section 1 and has undergone various processing operations performed in the sections of the printer main unit 20 is conveyed through the discharge-conveyance section 10 provided below the form feeding section 1 to the sorting unit 11. That is, a feed path 512 extending in the form feeding section 1 and a discharge conveyance path 513 extending in the discharge-conveyance section 10 are arranged side by side in the vertical direction. If a unit is inserted between the printer main unit 20 and the sorting unit 11 and the feed path 512 or the discharge conveyance path 513 is blocked by the inserted unit, the conveyance path extending from the continuous-form roll to the discharge trays is blocked, disabling the performance of some processing operations. In the embodiment of the present invention, the form feeding unit 51 to be inserted between the printer main unit 20 and the sorting unit 11 has the feed path 511 and the discharge conveyance path 510 extending horizontally. The positions of the entrance 515 and the exit 514 of the feed path 511 in the form feeding unit 51 and the entrance of the printer main unit 20 (in the embodiment, the entrance of the decurling section 2) coincide with one another when seen in the conveyance direction. In the embodiment, the entrance 515 and the exit 514 of the feed path 511 in the form feeding unit 51 and the entrance of the printer main unit 20 (the entrance of the decurling section 2) are of substantially the same size and shape with a thickness, i.e., a height, and a width both larger than those of a continuous form of the largest size to be used. Furthermore, the positions of the entrance 515, the exit 514, and the entrance of the printer main unit 20 are the same both in level and in width direction orthogonal to the conveyance direction. If the entrance 515, the exit 514, and the entrance of the printer main unit 20 are not of the same size and shape, the entrance 515, the exit 514, and the entrance of the printer main unit 20 coincide with one another in terms of the levels of the lowermost parts thereof and the widthwise centers thereof.

Furthermore, the positions of the entrance 516 and the exit 517 of the discharge conveyance path 510 in the form feeding unit 51, the exit of the printer main unit 20 (in the embodiment, the exit of the discharge-conveyance section 10), and the entrance of the sorting unit 11 coincide with one another when seen in the conveyance direction. In the embodiment, the entrance 516 and the exit 517, the exit of the printer main unit 20, and the entrance of the sorting unit 11 are of substantially the same size and shape with a thickness, i.e., a height, and a width both larger than those of a continuous form of the largest size to be used. Furthermore, the positions of the entrance 516 and the exit 517, the exit of the printer main unit 20, and the entrance of the sorting unit 11 are the same both in level and in width direction orthogonal to the conveyance direction. If the entrance 516 and the exit 517, the exit of the printer main unit 20, and the entrance of the sorting unit 11 are not of the same size and shape, the entrance 516 and the exit 517, the exit of the printer main unit 20, and the entrance of the sorting unit 11 coincide with one another in terms of at least the levels of the lowermost parts thereof and the widthwise centers thereof.

The feed path 511 and the discharge conveyance path 510 extending horizontally have widths that are larger than the width of a continuous form of the largest size to be used. Therefore, by simply connecting the form feeding unit 51 to the printer main unit 20 and the sorting unit 11, the feed path 511 and the discharge conveyance path 510 extending in respective directions are easily made to continue to and from the conveyance paths in the units 20 and 11 without positional deviation, whereby accurate and stable conveyance is realized. If a plurality of form feeding units 51 are provided, the entrances 515 and exits 514 of the feed paths 511 of the sheet feeding units 51 are positioned in such a manner as to coincide with one another when seen in the conveyance direction, in terms of at least the levels of the lowermost parts thereof and the widthwise centers thereof. Likewise, the entrances 516 and the exits 517 of the discharge conveyance paths 510 of the form feeding units 51 are positioned in such a manner as to coincide with one another when seen in the conveyance direction, in terms of at least the levels of the lowermost parts thereof and the widthwise centers thereof. Therefore, when a plurality of form feeding units 51 are connected to one another, the feed paths 511 and the discharge conveyance paths 510 thereof are continued from and to one another.

As described above, the printer according to the embodiment of the present invention is capable of performing printing not only on the continuous form fed from either of the two rolls R1 and R2, as shown in FIGS. 1 to 3, but also on any of continuous forms of more kinds, with different sizes and/or different materials, with ease. To do so, one or more form feeding units 51 are merely inserted between the printer main unit 20 and the sorting unit 11, which are provided as connectable units, and are connected thereto, and there is no need to open the printer main unit 20, remove a continuous-form roll from the form feeding section 1, and place another continuous-form roll into the form feeding section 1. Moreover, alignment of the conveyance paths (the feed path 511 and the discharge conveyance path 510) and other relevant operations are not necessary, realizing a very simple work. The form feeding unit 51 is connectable not only to the printer main unit 20 and the sorting unit 11 but also to another form feeding unit 51. If it is desired to perform recording on many kinds of continuous forms, an unlimited number of form feeding units 51 can be added, theoretically, in accordance with the number of kinds of continuous forms. Accordingly, an unlimited number of kinds of continuous forms can be handled.

In the example shown in FIGS. 1 to 3 and 5, the printer main unit 20 initially includes one form feeding section 1 and one discharge-conveyance section 10. The form feeding section 1 and the discharge-conveyance section 10 may be omitted from the printer main unit 20 (no corresponding drawings are provided) if at least one form feeding unit 51 is provided without fail between the printer main unit 20 and the sorting unit 11. In such a case, naturally, a number of form feeding units 51 are connectable.

Figure 6:
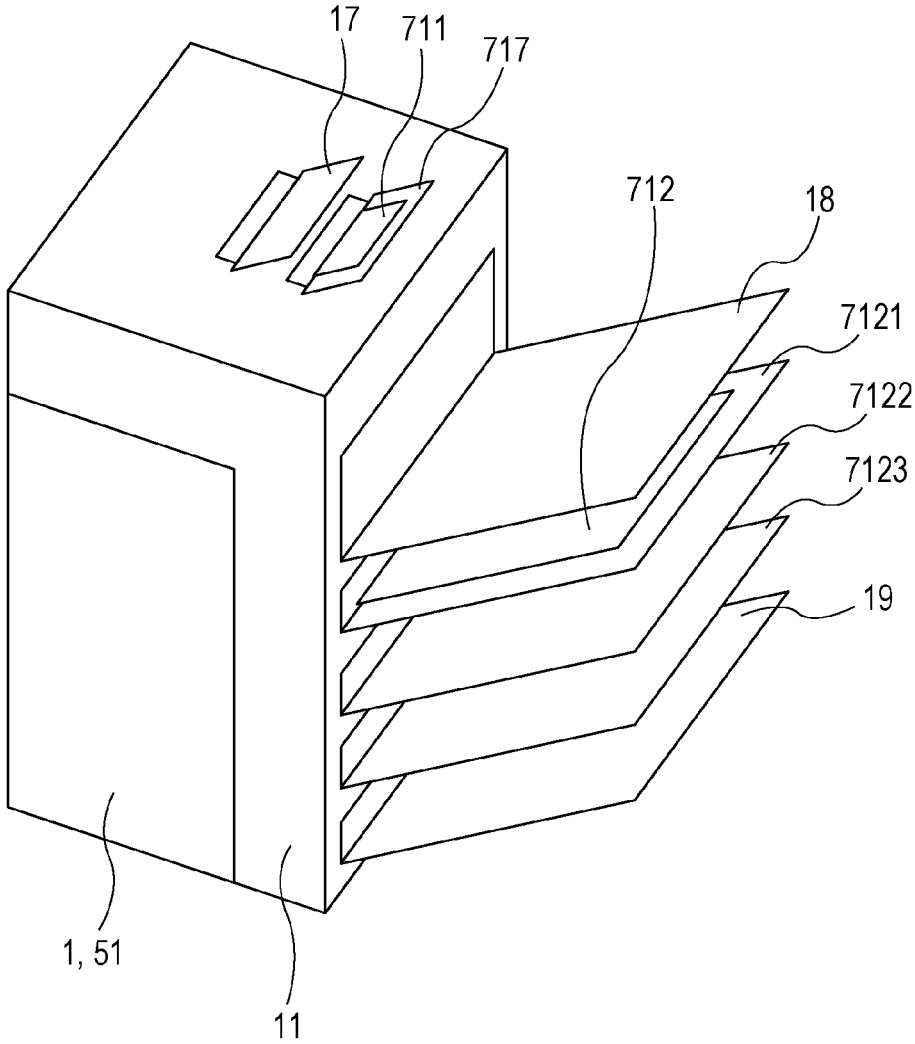
FIG. 6 is a perspective view of a sorting unit included in the printer shown in FIGS. 1 and 5.

The arrangement of the discharge trays of the sorting unit 11 according to the embodiment of the present invention will now be described. Referring to FIG. 6, the conveyance path in the sorting unit 11 extends from near the bottom of the sorting unit 11, runs along a side face of the sorting unit 11 remote from the printer main unit 20 or the form feeding unit 51, and reaches a face (the top face) continued from the foregoing side face. The discharge trays of the sorting unit 11 are positioned both on a lateral side and on the upper side with respect to the form feeding section 1 (or the form feeding unit 51). The large-sized-sheet discharge trays 18, 7121, 7122, and 7123 and the unnecessary-sheet discharge tray 19 are provided on the lateral side with respect to the form feeding section 1 (or the form feeding unit 51), i.e., on the side face of the sorting unit 11. More specifically, the large-sized-sheet bulk discharge tray 18 having the largest capacity among the large-sized-sheet discharge trays is provided at the uppermost position on the side face of the sorting unit 11, and the unnecessary-sheet discharge tray 19 is provided at the lowermost position on the side face of the sorting unit 11. The discharge trays 7121, 7122, and 7123 provided between the large-sized-sheet bulk discharge tray 18 and the unnecessary-sheet discharge tray 19 are referred to as the large-sized-sheet discharge trays 12 not having large capacities. Large-sized sheets 712 are to be discharged to any of the large-sized-sheet discharge trays 12 and the large-sized-sheet bulk discharge tray 18. Unnecessary sheets are to be discharged to the unnecessary-sheet discharge tray 19.

The small-sized-sheet discharge trays 17 and 717 are provided on the upper side with respect to the form feeding section 1 (or the form feeding unit 51), i.e., on the top face of the sorting unit 11. Small-sized sheets 711 are discharged to either of the small-sized-sheet discharge trays 17 and 717. Large-sized sheets 712 and small-sized sheets 711 mentioned herein are distinguished from each other by at least the dimension in the width direction orthogonal to the conveyance direction. Small-sized sheets 711 can be discharged to the large-sized-sheet discharge trays 12 and 18, whereas large-sized sheets 712 cannot be discharged to the small-sized-sheet discharge trays 17 and 717.

The technical significance of such an arrangement is as follows. The conveyance path in the sorting unit 11 according to the embodiment extends from near the bottom (lower side) to the top (upper side), as shown in FIG. 6. As the conveyance path becomes longer, the possibility of occurrence of a paper jam becomes higher. In addition, the possibility of occurrence of a paper jam is higher in the case of large-sized sheets 712 than in the case of small-sized sheets 711 because large-sized sheets 712 come into contact with more members provided in the sorting unit 11. Therefore, large-sized sheets 712 are discharged on the upstream side in the conveyance direction with respect to the position where small-sized sheets 711 are discharged, whereby the length of the conveyance path for large-sized sheets 712 is reduced. Thus, the occurrence of a paper jam is prevented effectively. In the embodiment, the large-sized-sheet discharge trays 18, 7121, 7122, and 7123 are provided on the side face of the sorting unit 11 (on the upstream side in the conveyance direction), and the small-sized-sheet discharge trays 17 and 717 are provided on the top face of the sorting unit 11 (on the downstream side in the conveyance direction). Thus, the possibility of occurrence of a paper jam is reduced. Unnecessary sheets may include those that are partially folded and/or those that are sticky because of wet ink that has not been dried sufficiently. Such sheets frequently cause paper jams. Therefore, the unnecessary-sheet discharge tray 19 is provided at the lowermost position on the side face of the sorting unit 11, whereby the possibility of occurrence of a paper jam is further reduced. Since the unnecessary-sheet discharge tray 19 is provided at the lowermost position on the side face of the sorting unit 11, unnecessary sheets can be relatively easily removed for disposal. In addition, if the unnecessary-sheet discharge tray 19 becomes full and some unnecessary sheets fall off the unnecessary-sheet discharge tray 19, such sheets do not disturb the other discharge trays.

The small-sized-sheet discharge trays 17 and 717 provided on the top face of the sorting unit 11 have small widths. Therefore, members forming a portion of the conveyance path near the top face of the sorting unit 11 and other members associated therewith can be provided with small widths and light weights, as described below. That is, relatively small and light members are provided on the upper side of the sorting unit 11. Therefore, the configuration of the sorting unit 11 can be simplified compared to a case where large and heavy members are provided on the upper side.

Figure 7:
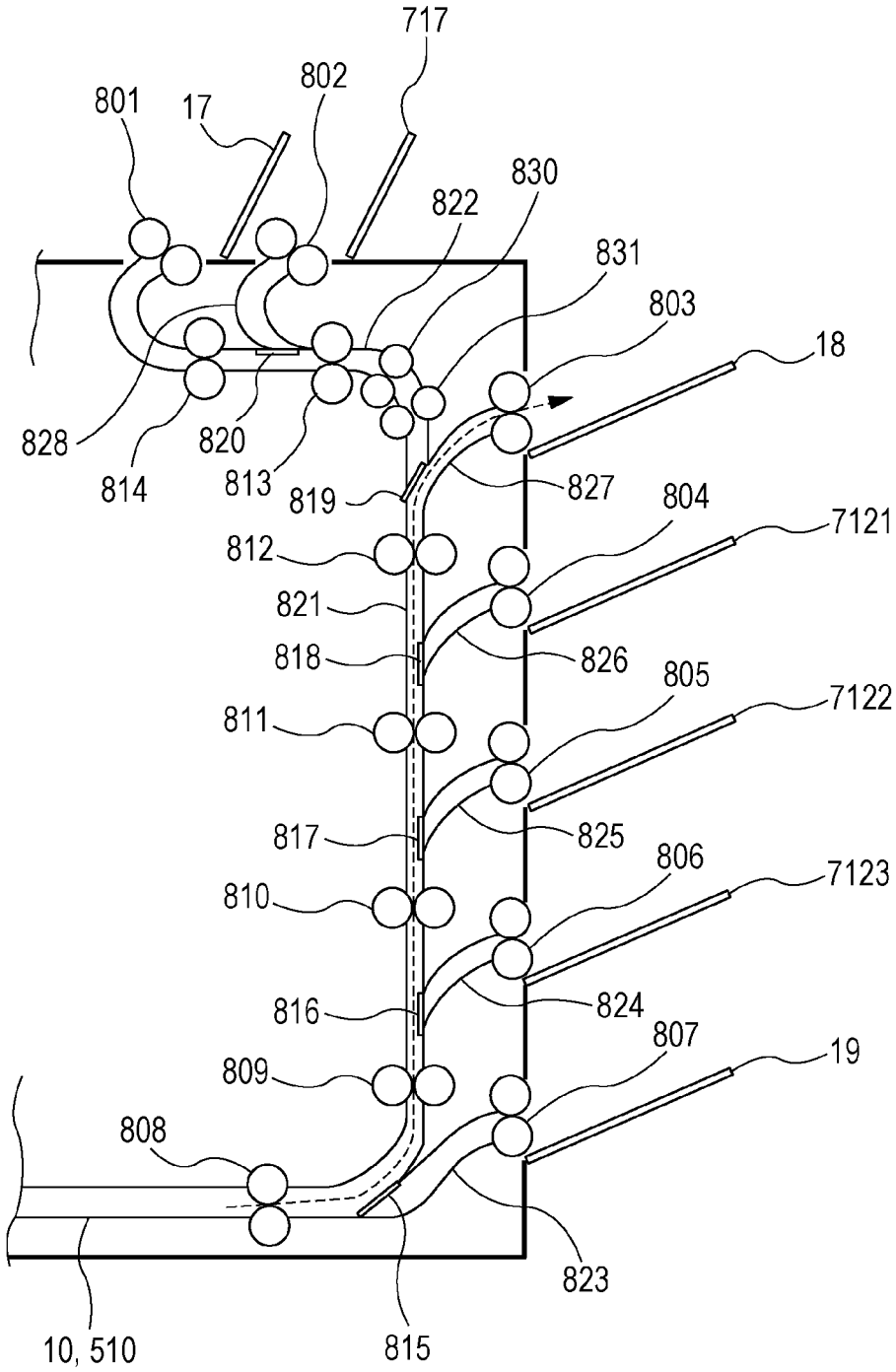
FIG. 7 is a schematic diagram showing the initial state of the sorting unit shown in FIG. 6.

The internal configuration of the sorting unit 11 will now be described more specifically. Referring to FIG. 7, the conveyance path extending in the sorting unit 11 includes a main conveyance path 821 for large-sized sheets and a main conveyance path 822 for small-sized sheets. Furthermore, the main conveyance path 821 for large-sized sheets branches into sub-conveyance paths 823 to 827, and the main conveyance path 822 for small-sized sheets branches into a sub-conveyance path 828. Pairs of rollers (each pair including a conveying roller and a pinch roller) 801 to 814 and 830 to 831 that convey the sheet are provided on the foregoing conveyance paths. The conveying rollers included in the pairs of rollers 801 to 814 and 830 to 831 are driven by actuators (not shown).

Flap members 815 to 820 are provided at branch points, respectively, between the main conveyance paths 821 and 822 and the sub-conveyance paths 823 to 828. The flap members 815 to 820 are moved by actuators 1015 to 1020 described below, and are capable of switching the direction in which the sheet advances between the main conveyance paths 821 and 822 and the sub-conveyance paths 823 to 828.

Figure 11:
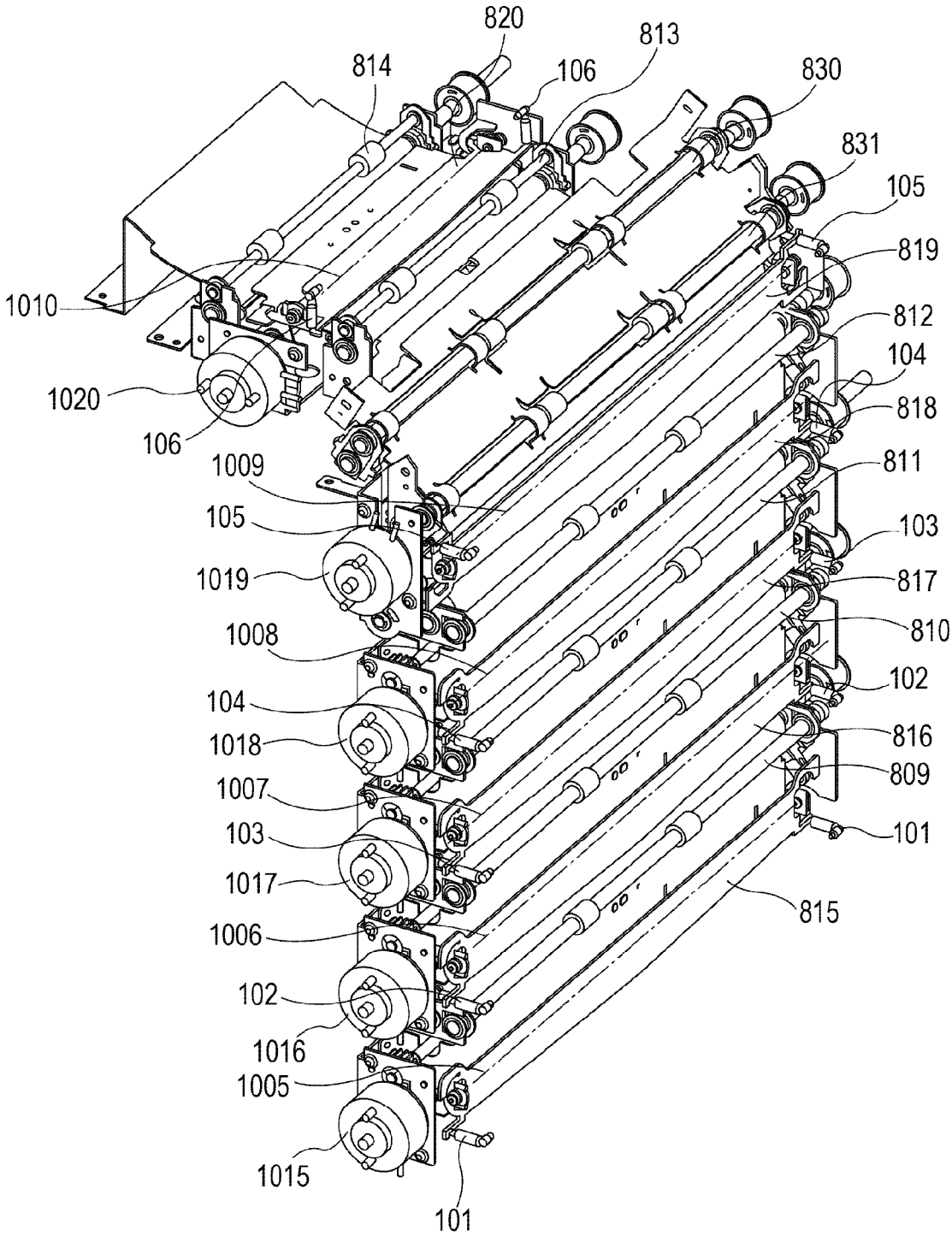
FIG. 11 is a perspective view showing the internal configuration of the sorting unit shown in FIG. 6.

FIG. 7 shows the initial state for the conveyance of large-sized sheets 712 where the flap members 815 to 820 are not moved by the actuators 1015 to 1020 (see FIG. 11). The sub-conveyance paths 823 to 826 branching off from the main conveyance paths 821 and 822 are closed by the flap members 815 to 818 (the sheet is prevented from entering the sub-conveyance paths 823 to 826), whereas the sub-conveyance path 827 reaching the large-sized-sheet bulk discharge tray 18 is open without being closed by the flap member 819. In this state, the sheet is guided into the sub-conveyance path 827 and is discharged to the large-sized-sheet bulk discharge tray 18. The sheet to be discharged to the large-sized-sheet bulk discharge tray 18 in this state may not necessarily be a large-sized sheet 712. A small-sized sheet 711 may be conveyed and be discharged to the large-sized-sheet bulk discharge tray 18. Even if sheets are to be discharged without being sorted, all the sheets may be discharged to the large-sized-sheet bulk discharge tray 18. The large-sized-sheet bulk discharge tray 18 has such a width that sheets of the largest size to be used can be received. The large-sized-sheet bulk discharge tray 18 has a large capacity and provides ease of removal of sheets. Therefore, the large-sized-sheet bulk discharge tray 18 is most frequently used even if sorting is unnecessary. In the embodiment, the state where sheets are to be discharged to the large-sized-sheet bulk discharge tray 18 is referred to as the non-drive initial state, where the actuators 1015 to 1020 do not need to be driven.

Figure 8:
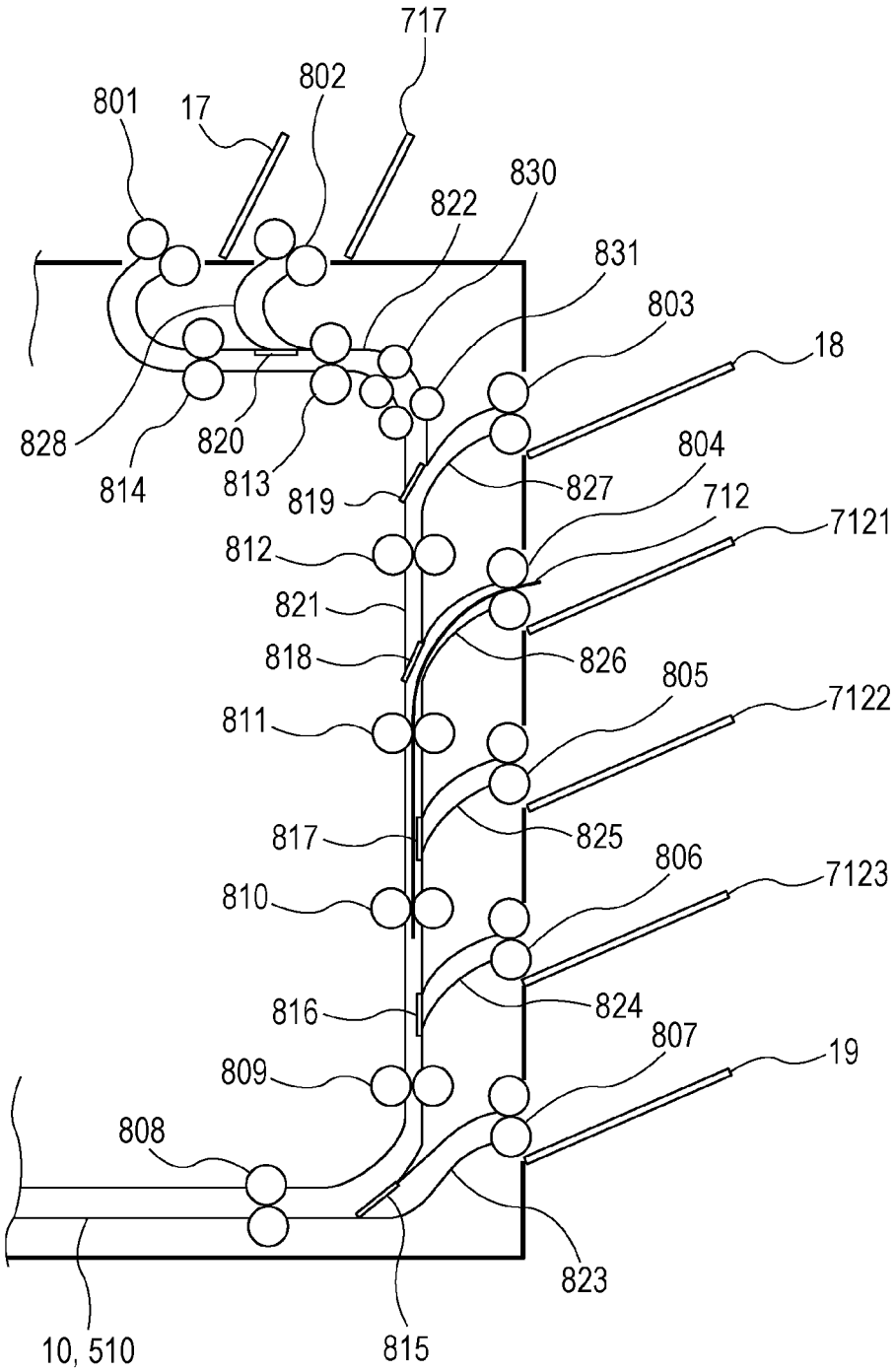
FIG. 8 is a schematic diagram showing an exemplary state of the sorting unit shown in FIG. 6 where a large-sized sheet is being discharged.

FIG. 8 shows a state where a large-sized sheet 712 is being discharged to the large-sized-sheet discharge tray 7121, specifically, a state where the flap member 818 is moved from the initial position shown in FIG. 7 toward the main conveyance path 821, whereby the large-sized sheet 712 is guided into the sub-conveyance path 826 toward the large-sized-sheet discharge tray 7121. This concerns a case where sheets are sorted and are discharged not only to the large-sized-sheet bulk discharge tray 18 but also to another discharge tray.

Figure 9:
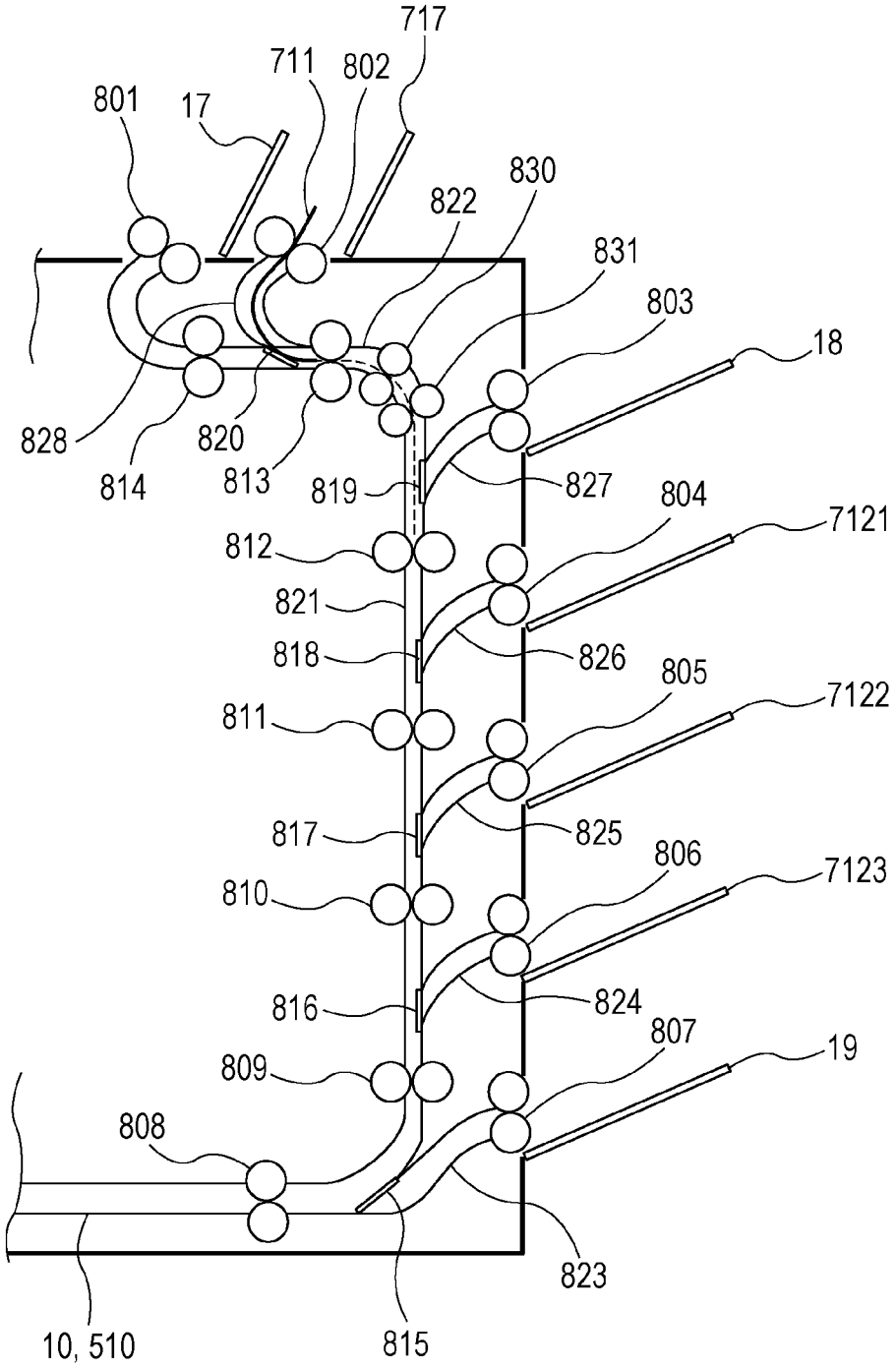
FIG. 9 is a schematic diagram showing an exemplary state of the sorting unit shown in FIG. 6 where a small-sized sheet is being discharged.

FIG. 9 shows a state where a small-sized sheet 711 is being discharged to the small-sized-sheet discharge tray 717, specifically, a state where the flap member 819 is moved from the initial position shown in FIG. 7 to such a position as to close the sub-conveyance path 827 reaching the large-sized-sheet bulk discharge tray 18, and the flap member 820 is moved toward the main conveyance path 822. Thus, the small-sized sheet 711 is guided from the main conveyance path 821 through the main conveyance path 822 into the sub-conveyance path 828 and is discharged to the small-sized-sheet discharge tray 717.

Figure 10:
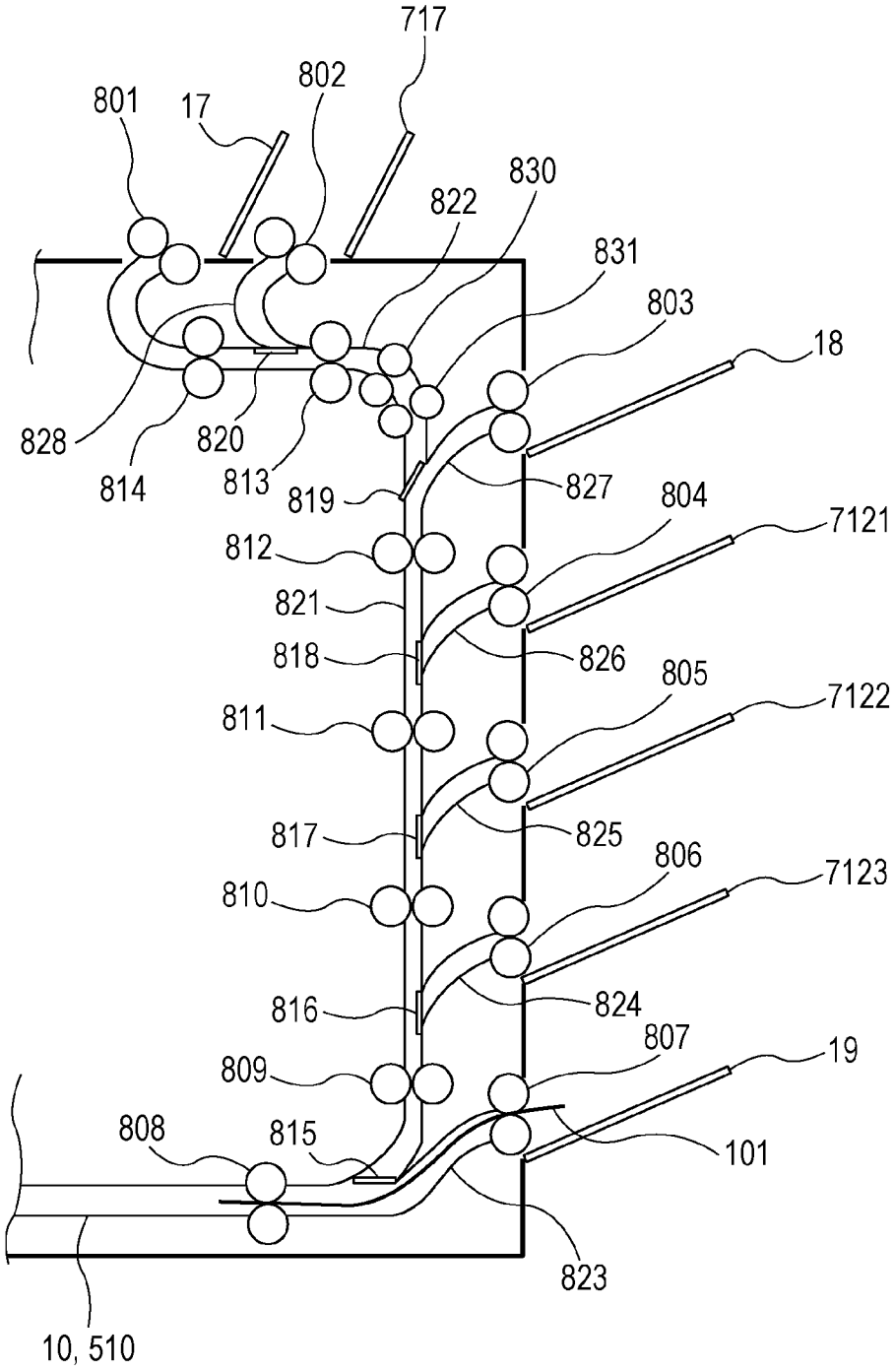
FIG. 10 is a schematic diagram showing a state of the sorting unit shown in FIG. 6 where an unnecessary sheet is being discharged.

FIG. 10 shows a state where an unnecessary sheet 101 is being discharged to the unnecessary-sheet discharge tray 19. For example, when any failure is detected by the inspecting section 5, the flap member 815 is moved from the initial position shown in FIG. 7 to such a position as to close the main conveyance path 821 and to open the sub-conveyance path 823. Thus, the sheet detected to have failure is distinguished as an unnecessary sheet 101 from the other sheets that have been processed in a good manner, and is discharged to the unnecessary-sheet discharge tray 19.

FIG. 11 is a perspective view showing the internal configuration of the sorting unit 11 that discharges sheets as described above. For easier recognition, parts relevant to the main conveyance paths 821 and 822 are only shown. The sorting unit 11 includes the actuators 1015 to 1020 (in the embodiment, rotary solenoids) that move the flap members 815 to 820. The flap members 815 to 820 in the non-drive initial state are urged by springs 101 to 106, respectively, thereby being retained at the initial positions shown in FIG. 7. When the actuators 1015 to 1020 are driven, the flap members 815 to 820 overcome the urging forces of the springs 101 to 106 and turn about center shafts 1005 to 1010, respectively. When the driving of the actuators 1015 to 1020 is stopped, the flap members 815 to 820 return to the initial positions with the urging forces of the springs 101 to 106.

The springs 101 to 104 are provided on the upstream side in the conveyance direction with respect to the center shafts 1005 to 1008 provided for the flap members 815 to 818, whereas the springs 105 are provided on the downstream side in the conveyance direction with respect to the center shaft 1009 provided for the flap member 819. In the initial state, the flap member 819 is urged in such a direction as to open the sub-conveyance path 827, unlike are the flap members 815 to 818.

According to such a configuration, no large-sized sheets 712 but small-sized sheets 711 are conveyed toward the downstream side with respect to the flap member 819. Therefore, the main conveyance path 822 and the sub-conveyance path 828 provided on the downstream side and extending near the top face of the sorting unit 11 can be provided with widths that correspond to the sizes of small-sized sheets 711. Consequently, the sizes and weights of members to be provided near the top face of the sorting unit 11 can be reduced, increasing the degree of flexibility in selecting the materials and configurations of the casing of the sorting unit 11 and mechanisms supporting the relevant members. In the initial state, the flap member 819 is urged in such a direction as to open the sub-conveyance path 827, opposite to the direction in which the other flap members 815 to 818 provided on the upstream side in the conveyance direction with respect thereto are urged. Therefore, even if the actuators 1015 to 1020 should fail and the flap members 815 to 820 should be immovable, there is no chance that a large-sized sheet 712 enters the main conveyance path 822 on the downstream side with respect to the flap member 819. Accordingly, the occurrence of a paper jam due to the entrance of a large-sized sheet 712 into the conveyance paths 822 and 828 for small-sized sheets is prevented, and the main conveyance path 822 and the sub-conveyance path 828 can be downsized, as described above.

To summarize, according to the present invention, the number of kinds of sheets, as recording media, to be handled can be easily increased arbitrarily, which has not been considered in, for example, Japanese Patents Laid-Open No. 5-4773 and No. 9-301623. Accordingly, high expandability is realized. Moreover, since both feeding and discharging of sheets are performed on one specific side of the printer, good operability is provided and a downsized configuration is realized.

Furthermore, the large-sized-sheet discharge trays are provided on the upstream side in the conveyance direction with respect to the small-sized-sheet discharge trays, whereby no large-sized sheets are allowed to be conveyed to the downstream portion of the conveyance path. Therefore, the sizes and weights of the conveyance paths, discharge trays, and relevant members provided in the downstream portion can be reduced in accordance with the sizes of small-sized sheets to be handled. Accordingly, the configuration of the sorting unit can be simplified and, with an increased degree of flexibility in the selection of materials and configurations, costs can be reduced. Furthermore, since no large-sized sheets are conveyed to the downstream portion of the conveyance path, the possibility of occurrence of a paper jam is reduced. Furthermore, by positioning one of the large-sized-sheet discharge trays that has the largest capacity (the large-sized-sheet bulk discharge tray) at the uppermost position on the side face of the sorting unit, relatively high operability is realized even though the discharge trays are not provided at large intervals. In addition, by positioning the unnecessary-sheet discharge tray on the upstream side in the conveyance direction with respect to the large-sized-sheet discharge trays, unnecessary sheets having some failure are prevented from being conveyed to the downstream portion of the conveyance path, whereby the occurrence of a paper jam due to an unnecessary sheet is prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-103797 filed Apr. 28, 2010, which is hereby incorporated by reference herein in its entirety.

What is claimed is:

1. A sheet feeding unit to be inserted between a printer main unit configured to perform printing on a sheet and a discharging unit having a plurality of discharge trays to which the sheet that has undergone printing is to be discharged, the sheet feeding unit being connectable to the printer main unit, the discharging unit, and another sheet feeding unit, the sheet feeding unit comprising:

a casing in which the sheet, as a recording medium, is housed and through which a feed path and a discharge conveyance path extend horizontally, the feed path being configured to feed the sheet to the printer main unit, the discharge conveyance path being configured to convey the sheet that has undergone printing performed by the printer main unit to the discharging unit, wherein the casing has on a face thereof adjacent to the printer main unit an exit of the feed path and an entrance of the discharge conveyance path, and on a face thereof adjacent to the discharging unit an entrance of the feed path and an exit of the discharge conveyance path, and wherein the positions of the exit and entrance of the feed path coincide with each other when seen in a conveyance direction in which the sheet is conveyed, and the positions of the entrance and exit of the discharge conveyance path coincide with each other when seen in the conveyance direction.

2. A printer comprising:

a printer main unit;

a discharging unit; and at least one sheet feeding unit according to claim 1 provided between the printer main unit and the discharging unit, wherein the positions of the entrance and exit of the feed path of the sheet feeding unit and an entrance of the printer main unit from which the sheet enters coincide with one another when seen in the conveyance direction, and wherein the positions of the entrance and exit of the discharge conveyance path of the sheet feeding unit, an exit of the printer main unit from which the sheet exits, and an entrance of the discharging unit from which the sheet enters coincide with one another when seen in the conveyance direction.

3. The printer according to claim 2, wherein a conveyance path in the discharging unit includes a large-sized-sheet conveyance path provided on the upstream side in the conveyance direction; and a small-sized-sheet conveyance path provided on the downstream side with respect to the large-sized-sheet conveyance path and whose width in a direction orthogonal to the conveyance direction is smaller than that of the large-sized-sheet conveyance path, and wherein the large-sized-sheet conveyance path is connected to a large-sized-sheet discharge tray, and the small-sized-sheet conveyance path is connected to a small-sized-sheet discharge tray.

4. The printer according to claim 3, wherein the discharging unit has the discharge trays on a first face thereof opposite a second face thereof connected to the sheet feeding unit and on a third face continued from the first face, and wherein the conveyance path in the discharging unit extends along the first face and reaches the third face, the large-sized-sheet discharge tray is provided on the first face, and the small-sized-sheet discharge tray is provided on the third face.

5. The printer according to claim 3, wherein an unnecessary-sheet discharge tray is provided on the upstream side in the conveyance direction with respect to the large-sized-sheet discharge tray.

6. The printer according to claim 3, wherein the discharge conveyance path in the sheet feeding unit is provided at a lower level than the feed path, and the exit of the printer main unit is provided at a lower level than the entrance of the printer main unit, wherein the discharging unit has a first face, a second face opposite the first face and connected to the sheet feeding unit, and a third face continued from the first face, wherein the conveyance path in the discharging unit extends from near a bottom face to a top face, the top face being the third face of the discharging unit, and wherein the large-sized-sheet discharge tray includes a plurality of large-sized-sheet discharge trays including a large-sized-sheet bulk discharge tray having the largest capacity there among, the large-sized-sheet bulk discharge tray being provided at an uppermost position on the first face of the discharging unit.

7. The printer according to claim 6, wherein the conveyance path in the discharging unit includes a main conveyance path extending in the conveyance direction and sub-conveyance paths branching off from the main conveyance path and extending to the discharge trays, wherein flap members capable of changing a direction in which the sheet advances are provided at branch points, respectively, between the main conveyance path and the sub-conveyance paths, wherein, in a non-drive initial state, one of the flap members provided at a corresponding one of the branch points between the main conveyance path and one of the sub-conveyance paths that is connected to the large-sized-sheet bulk discharge tray is oriented in such a manner as to guide the sheet to the one sub-conveyance path, and wherein, in the non-drive initial state, the other flap members provided at the other branch points between the main conveyance path and the other sub-conveyance paths that are connected to the discharge trays provided on the upstream side in the conveyance direction with respect to the large-sized-sheet bulk discharge tray are oriented in such a manner as to prevent the sheet from entering the other sub-conveyance paths.

8. A sheet feeding unit to be positioned between a printer main unit configured to perform printing on a sheet and a discharge unit having a plurality of discharge trays to which the sheet that has been printed is to be discharged, the sheet feeding unit being connectable to the printer main unit positioned adjacent to a first lateral side of the sheet feeding unit, and the sheet feeding unit being selectively connectable to the discharge unit and another sheet feeding unit positioned adjacent to a second lateral side of the sheet feeding unit opposite the first lateral side, the sheet feeding unit comprising:

a housing portion configured to house a sheet to be fed to the printer main unit;

a feed path configured to supply a sheet having been supplied from said another sheet feeding unit to the printer main unit; and a discharge conveyance path configured to transport a sheet that has been printed by the printer main unit to the discharge unit.

9. The sheet feeding unit according to claim 8, wherein the feed path and the discharge conveyance path are provided horizontally.

10. A printer comprising:

a printer main unit;

a discharging unit; and at least one sheet feeding unit according to claim 8 provided between the printer main unit and the discharge unit, wherein the positions of the entrance and exit of the feed path of the sheet feeding unit and an entrance of the printer main unit from which the sheet enters coincide with one another when seen in the conveyance direction, and wherein the positions of the entrance and exit of the discharge conveyance path of the sheet feeding unit, an exit of the printer main unit from which the sheet exits, and an entrance of the discharging unit from which the sheet enters coincide with one another when seen in the conveyance direction.

11. The printer according to claim 10, wherein a conveyance path in the discharging unit includes a large-sized-sheet conveyance path provided on the upstream side in the conveyance direction; and a small-sized-sheet conveyance path provided on the downstream side with respect to the large-sized-sheet conveyance path and whose width in a direction orthogonal to the conveyance direction is smaller than that of the large-sized-sheet conveyance path, and wherein the large-sized-sheet conveyance path is connected to a large-sized-sheet discharge tray, and the small-sized-sheet conveyance path is connected to a small-sized-sheet discharge tray.

12. The printer according to claim 11, wherein the discharging unit has the discharge trays on a first face thereof opposite a second face thereof connected to the sheet feeding unit and on a third face continued from the first face, and wherein the conveyance path in the discharging unit extends along the first face and reaches the third face, the large-sized-sheet discharge tray is provided on the first face, and the small-sized-sheet discharge tray is provided on the third face.

13. The printer according to claim 11, wherein an unnecessary-sheet discharge tray is provided on the upstream side in the conveyance direction with respect to the large-sized-sheet discharge tray.

14. The printer according to claim 11, wherein the discharge conveyance path in the sheet feeding unit is provided at a lower level than the feed path, and the exit of the printer main unit is provided at a lower level than the entrance of the printer main unit, wherein the discharging unit has a first face, a second face opposite the first face and connected to the sheet feeding unit, and a third face continued from the first face, wherein the conveyance path in the discharging unit extends from near a bottom face to a top face, the top face being the third face of the discharging unit, and wherein the large-sized-sheet discharge tray includes a plurality of large-sized-sheet discharge trays including a large-sized-sheet bulk discharge tray having the largest capacity there among, the large-sized-sheet bulk discharge tray being provided at an uppermost position on the first face of the discharging unit.

15. The printer according to claim 14, wherein the conveyance path in the discharging unit includes a main conveyance path extending in the conveyance direction and sub-conveyance paths branching off from the main conveyance path and extending to the discharge trays, wherein flap members capable of changing a direction in which the sheet advances are provided at branch points, respectively, between the main conveyance path and the sub-conveyance paths, wherein, in a non-drive initial state, one of the flap members provided at a corresponding one of the branch points between the main conveyance path and one of the sub-conveyance paths that is connected to the large-sized-sheet bulk discharge tray is oriented in such a manner as to guide the sheet to the one sub-conveyance path, and wherein, in the non-drive initial state, the other flap members provided at the other branch points between the main conveyance path and the other sub-conveyance paths that are connected to the discharge trays provided on the upstream side in the conveyance direction with respect to the large-sized-sheet bulk discharge tray are oriented in such a manner as to prevent the sheet from entering the other sub-conveyance paths.

16. A sheet feeding unit comprising:

a first conveyance path configured to guide a sheet from a first entrance provided on a first lateral side to a first exit provided on a second lateral side opposite to the first lateral side;

a first conveyor configured to convey the sheet in the first conveyance path to the first exit;

a second conveyance path configured to guide the sheet from a second entrance provided on the second lateral side to a second exit provided on the first lateral side;

a second conveyor configured to convey the sheet in the second conveyance path to the second exit;

a sheet supporting portion supporting the sheet; and a sheet feeder configured to feed the sheet supported in the sheet supporting portion into the first conveyance path.

17. The sheet feeding unit according to claim 16, wherein the sheet supporting portion supports a continuous form sheet wound in a roll.

18. The sheet feeding unit according to claim 16, wherein the sheet supporting portion is placed over the first conveyance path.

19. The sheet feeding unit according to claim 18, further comprising:

a second sheet supporting portion supporting a second sheet; and a second sheet feeder configured to feed the second sheet supported by the second supporting portion into the first conveyance path, wherein the second sheet supporting portion is placed under the first conveyance path.

20. The sheet feeding unit according to claim 19 wherein the second conveyance path is placed under the second sheet supporting portion.

* * * * *